US006821413B1

(12) United States Patent
Alkhalidl

(10) Patent No.: US 6,821,413 B1
(45) Date of Patent: Nov. 23, 2004

(54) METHOD AND APPARATUS FOR CONTINUOUS SEPARATION AND REACTION USING SUPERCRITICAL FLUID

(75) Inventor: Abdulhaq E. Alkhalidl, Pittsburgh, PA (US)

(73) Assignee: FluidPhase Technologies, Inc., Pittsburgh, PA (US)

( * ) Notice: Subject to any disclaimer, the term of this patent is extended or adjusted under 35 U.S.C. 154(b) by 325 days.

(21) Appl. No.: 09/654,097

(22) Filed: Aug. 31, 2000

(51) Int. Cl.[7] ..... C10M 175/00; C10G 21/28; C10G 21/00; C10C 3/08; C10C 1/18

(52) U.S. Cl. ..... 208/339; 208/179; 208/321; 208/45

(58) Field of Search ..... 208/45, 179, 321, 208/339

(56) References Cited

U.S. PATENT DOCUMENTS 4,695,372 A * 9/1987 Warzinski et al. ..... 208/311
4,806,228 A * 2/1989 Beneke et al. ..... 208/45
5,518,606 A * 5/1996 Mohle ..... 208/45

* cited by examiner

*Primary Examiner*—Walter D. Griffin
*Assistant Examiner*—Tam M. Nguyen
(74) *Attorney, Agent, or Firm*—Ference & Associates

(57) ABSTRACT

A method for the continuous process of fluids is based on mixing the fluid with a supercritical fluid. The mixing of the two fluids may be accomplished using either a co-flow or counter-flow process. The process focuses on the difference in the solubilities of the desired and the undesired components into supercritical fluid and de-emphasizes the influence of the contaminating components of the fluid to be processed. The process of the present invention is particularly advantageous to the recycling of industrial waste fluids, such as used oil, wherein the process is carried out by jet spray micro-orifices atomization of waste material with a supercritical fluid to dissolve oil from the waste material. Additional mixing devices such as a magneto driven impeller shaft and ultrasonic gun may be employed. Thereafter, un-dissolved components are separated, first and the dissolved fluid is then separated from the supercritical fluid. Various apparatus for carrying out the method are also disclosed.

9 Claims, 5 Drawing Sheets

Counter-Flow Reactor

Overall Block Diagram Co-Flow and Counter-Flow Sub-systems

Co-Flow Sub-System

Figure 3, Co-Flow Reactor

Counter-Flow sub-System

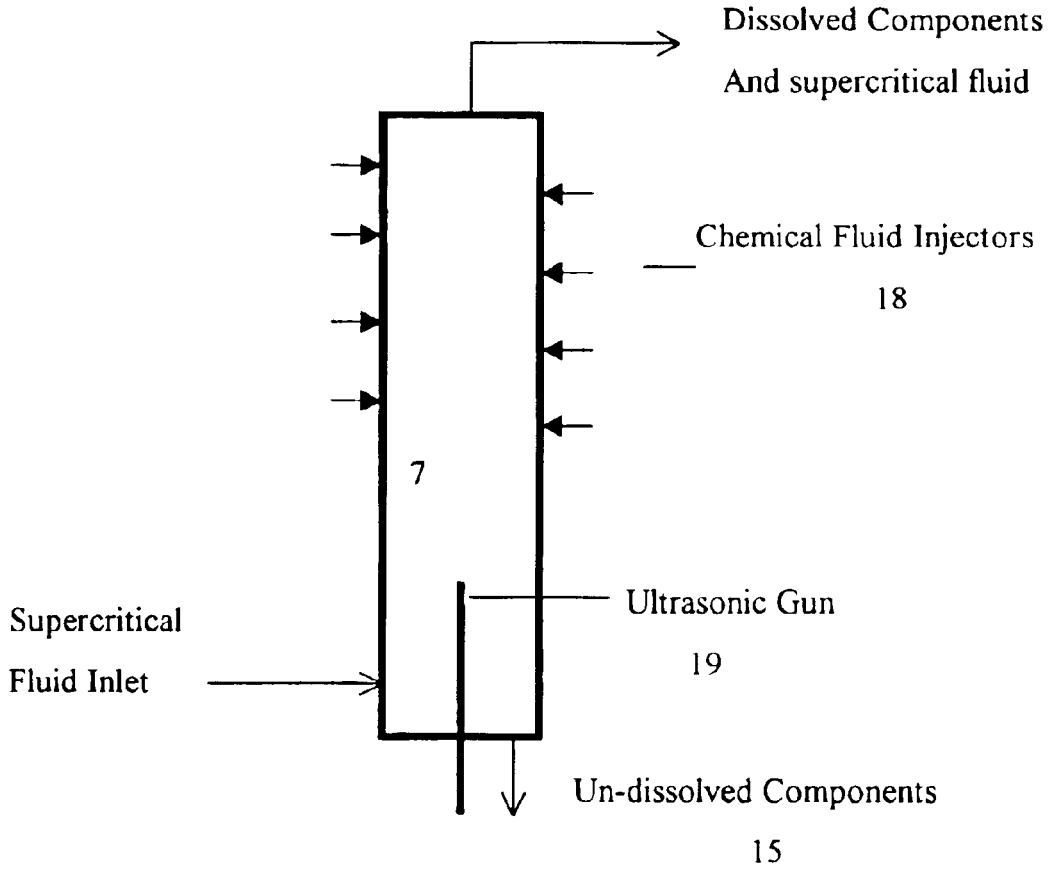
Figure 5, Counter-Flow Reactor

METHOD AND APPARATUS FOR CONTINUOUS SEPARATION AND REACTION USING SUPERCRITICAL FLUID

FIELD OF THE INVENTION

The present invention generally relates to continuous separation and reaction of chemical fluids (liquids, solutions and gases) using supercritical fluids, and more particularly to the separation of industrial fluids into sub-components based on the different solubility of the components in supercritical fluids.

BACKGROUND OF THE INVENTION

There are a number of applications in which chemical components in a mixture need to be separated. The fields of application include many industries such as chemical, environmental, food, medical, enzymatic, pharmaceutical and recycling. The problems to be overcome by the present invention will now be discussed with reference to the recycling industry, but it should be understood this discussion is representative of the problems faced by the other industries.

Used lubricating and hydraulic oils are generated by a number of industries, including automotive and commercial shops, large industrial manufacturing facilities, marine facilities and airline and railroad maintenance departments. Used oils are considered hazardous wastes and are heavily regulated. It is the contamination of these oils with water and waste products that prevent their continued use. Generators of used oils are responsible for cradle to grave management of these waste streams and, in most cases, contract with used oil recyclers to remediate or dispose of the waste under the laws that regulate the transport, processing and destruction of the various components that make up these particular waste streams.

Currently, on-site remediation of these waste streams proves to be quite costly. The generators must contract with firms that have special expertise in reclaiming these waste streams as an on-site service. As an alternative, used oil recyclers can pick up oil from generators for transportation back to a plant for processing. After the oil is processed it can be resold as industrial burning fuel. This process of treating used oils is complex, costly and time consuming and produces waste components that require further remediation. Further, these used oils that are burned as fuel oils result in the original value of the oil being greatly reduced. Thorough purification to achieve a state as close to original quality and value as possible, much of the value of these recycled materials can be recovered. It has been the lack of an economical purification process of sufficient quality that has prevented the direct reuse or higher value use of these materials.

The use of supercritical fluids for separation and purification is known. A supercritical fluid is named based on the physical properties exploited. When a gas is compressed and maintained below its critical temperature, it becomes liquid. If during the compression the liquid gas is allowed to exceed its critical temperature, it will result into a dense gas called as supercritical fluid, whose pressure and temperature are above its critical states.

Supercritical fluids have solvation power similar to liquids, but also possess higher diffusion coefficients and lower viscosities at the same temperature. Supercritical fluids have the potential to extract components from a mixture at a more rapid extraction rate than possible with liquid extraction. The "gas like" low viscosities of supercritical fluids are 10–100 times lower than for liquids, and high diffusivities are 10–100 times higher than for liquids. The densities of supercritical fluids are $10^2$ to $10^3$ times greater than that of a gas at room temperature. Consequently the molecular interactions are greater due to shorter intermolecular distances; hence the solvation power of supercritical fluids.

There are two general types of supercritical fluid systems typically employed for separation and purification. Both are fundamentally limited due to the specific technology and design approach. The first general type is a "batch" system, in which a batch is processed, the equipment is cleaned or serviced, another batch is processed, and the cycle is repeated as necessary. Batch systems operate at very high pressure and employ vessels of large volume; these systems are extremely expensive and inefficient. The second general type is a "continuous" system, in which the fluid to be processed is processed continuously, and not in "batches". Existing continuous supercritical fluid systems utilize counter flow technology, in which feed material flows from top to bottom of a very complex long vertical column and a supercritical fluid flows from bottom to top of the column selectively dissolving specific components from the feed liquid. Systems of this type are very inefficient and rely on a large surface area on a wire mesh inside the column to strip off lighter components from the feed liquid. It requires many temperature sensors and complex controls, and it has very limited flow efficiency. Consequently, the liquid is usually required to be recycled several times to sufficiently extract desired components.

Various supercritical fluids have been used to facilitate the separation of emulsions. U.S. Pat. No. 5,435,920 to Penth discloses a process for cleaving spent emulsions such as cooling lubricants by means of carbon dioxide under pressure, and if necessary, heat in an economic and environmentally friendly manner. The emulsion of cooling lubricant is saturated under pressure with carbon dioxide and is heated and/or cooled until cleavage is achieved. Above the cleavage temperature, a floating water-poor oil phase quickly forms above an oil-poor aqueous phase. The process is not very efficient economically due to the relatively low solubility of lubricant in carbon dioxide.

Yamaguchi et al., Volumetric Behavior of Ethyl Esters Related to Fish Oil in the Presence of Supercritical $CO_2$, the $4^{th}$ International Symposium on Supercritical Fluids, May 11–14, Sendai Japan (1997), pp. 485–488, discloses using supercritical $CO_2$ for the separation and fractionation of certain components of fish oil. The experimental apparatus included a static mixer in a water bath, and was a batch process. The batch process lowers the competitiveness of the process Another example of the use of supercritical $CO_2$ is Nagase et al., Development of New Process of Purification and Concentration of Ethanol Solution using Supercritical Carbon Dioxide, Id. at pp. 617–619. The experimental apparatus included a pre-heater and a static mixer in an air bath.

Subramanian, M, Supercritical fluid extraction of oil sand bitumen from Uinta Basin, (Utah, Ph.D. dissertation, University of Utah, Salt lake city, Utah, 1996) discloses the use of propane to fractionate oil sand bitumen into different fractions. The process was not continuous in nature. U.S. Pat. No. 2,196,989 to Henry et al. discloses the use of propane in a batch process to purify used engine oil. U.S. Pat. No. 3,870,625 to Wielezynski discloses mixing propane and used oil in a column and letting gravity settle unwanted material in the bottom of the tank. A series of columns allows for multiple repetitions until propane is finally separated from the oil. U.S. Pat. No. 5,556,548 discloses a method by which liquid propane is mixed with used oil and propane/soluble oil is separated from sludge and heavy metal using a settling tank and gravity.

Notwithstanding advances in the art, the need still exists for a process for treating chemical fluids, particularly the recycling of oil, which can be used on-site, which utilizes a continuous flow system and that proves to be cost effective and environmentally friendly.

SUMMARY OF THE INVENTION

This invention broadly contemplates continuous separation and reaction of chemical fluids (liquids, solutions and gases) using supercritical fluids, including the separation of industrial fluids into sub-components based on the different solubility of the components in supercritical fluids. The process focuses on the difference of the solubility of the desired and undesired components of the processed fluid in the supercritical fluid.

The first aspect of the invention is a continuous dynamic mixing of the chemical fluids with supercritical fluid. To achieve this goal the processed fluid is atomized into supercritical fluid using jet-spray micro orifices, additional means to achieve maximum thermodynamic equilibrium during resident time, is using magneto drive and Ultrasonication device.

Another aspect of the invention is using thermal energy to reach desired temperatures for both the process fluid and the supercritical fluid. Another aspect of the invention is the ability to have two modes of continuous operations as required, co-flow and counter-flow modes of operations.

Another aspect of the invention is the need for at least one separation vessel to separate soluble and un-dissolved components and another separation vessel to separate soluble components from the recyclable supercritical fluid. The fractionation of dissolved components, can be done according to their different solubilities in the supercritical fluid at different densities, by using several separation vessels Another aspect of the present invention is that it minimizes waste components that require further remediation. For example, when the present invention is used to process a petroleum product, the amount of water and other residues in the starting material does not alter the quality of the final product or its fundamental process procedure. The present invention minimizes the production of the rag layer, that is, un-dissolved oil residue and water layer. This reduces or eliminates another cost element, that is, disposing of the rag layer. The separated components (still under high pressure) can be made harmless to the environment by additional reactions, such as breaking down PCB's into harmless chemicals using on line supercritical water oxidation.

Another aspect of the present invention is that this system can be easily scaled or adapted to both volume and flow. Energy is conserved in the process as part of the fundamental design. The present invention can be scaled down to be dedicated for some specific applications. For example, it can be used on a small scale to recycle well-defined used oil, such as on merchant or navy ships, military engines and other such applications. The clean product can be used as clean engine oil after making up some of the depleted additives.

The present invention is also so compact that it can be used as a mobile processing system making it possible to take the present invention to the source. This is a strategic advantage and one that may introduce a new paradigm in this field. Because of this compact nature it is also possible to integrate the purification into other mechanical systems to continuously purify oil and solvent components.

The fundamental nature of the present invention is more amenable to real time application in conjunction with other process. The continuous operation and the fewer requirements for a holding tank, allow the process to be applied in other than tank or tanker batches and permit a new flexibility. By adding one module to the existing system it can also be used as a dedicated application for cleaning of oil contaminated solids such as metal parts, machinery or rags with the oil directed to the oil purification process.

Those and other advantages and benefits of the present invention will become apparent from the tailed Description of the Preferred Embodiment herein below

BRIEF DESCRIPTION OF THE DRAWINGS

FIG. 5 is a block diagram showing the preferred action with a reactor.

DETAILED DESCRIPTION OF THE PREFERRED EMBODIMENT

Figure 1:
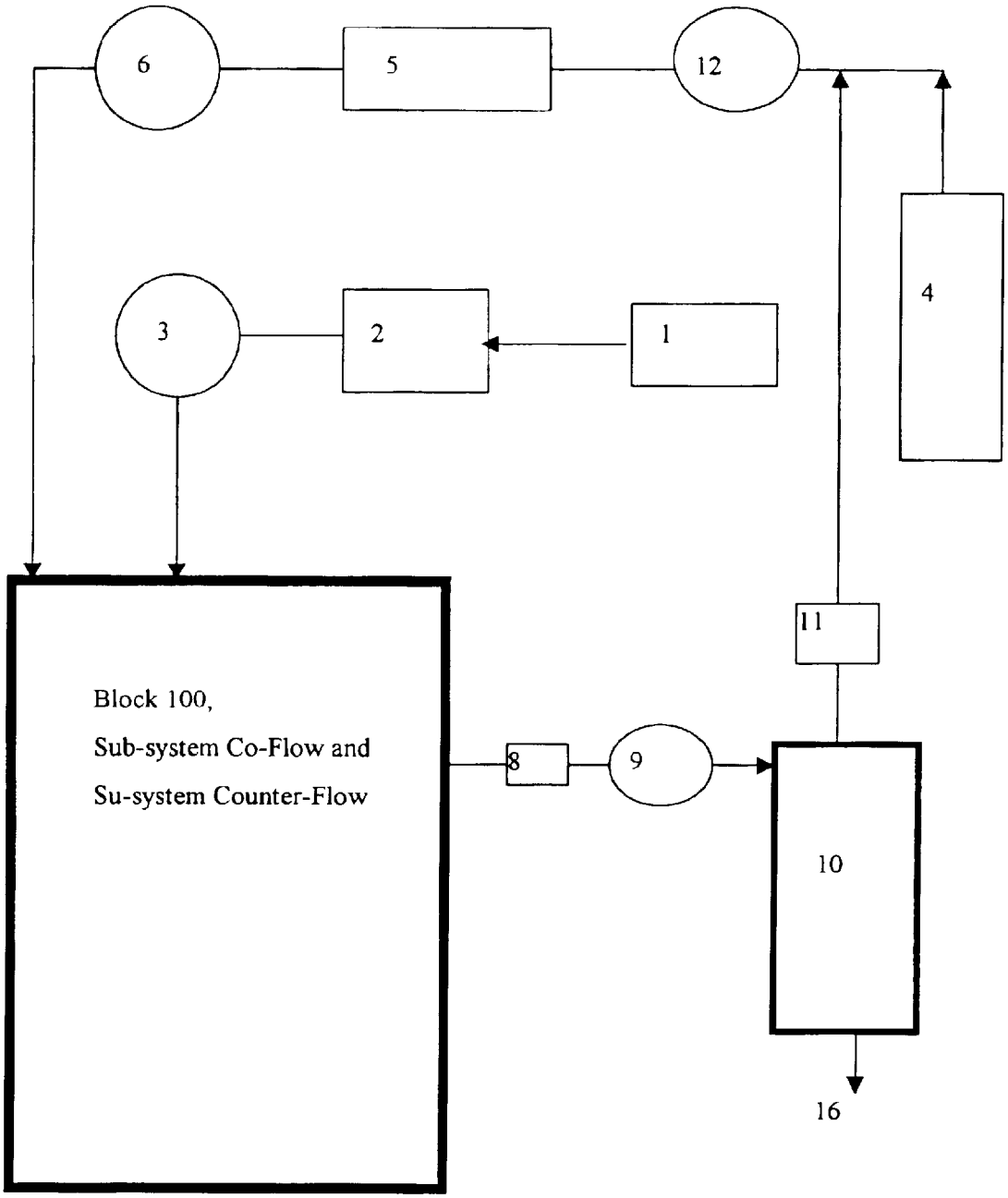
FIG. 1 depicts a block diagram of the major elements of a system capable of practicing the method of the present invention.

FIG. 1 depicts a block diagram of the major elements of a system capable of practicing the method of the present invention. The fluid to be processed is transferred from the chemical reservoir (1) by chemical fluid pump (2) into a heat exchanger (3), then into the sub-system (100). The sub-system (100) may be either co-flow or counter-flow, and the operation of each is discussed in detail below. Supercritical fluid is transferred from solvent liquid reservoir (4) by solvent pump (5) into high-pressure heat exchanger (6) to achieve supercritical conditions of temperature and pressure, then the supercritical fluid enters reactor (100). The high-pressure reactor is maid of metal alloy, which is not compatible with using another form of heating such as microwave. In addition using microwave compatible material such as peek will limit the maximum pressure and reduce the efficiency and the safety of the process. The dissolved components in the supercritical fluid are phased out from the supercritical fluid by lowering the pressure at cyclone separator (10) using backpressure regulators (11, 15) and heat exchanger (16). The supercritical fluid can be changed into liquid or gas by decreasing the pressure, this will result in the loss of the solvation power and hence, the phasing out of the dissolved components. The fractionation of dissolved components can be done according to their different solubilities in the supercritical fluid at different densities. The dissolved components can be phased out when the new conditions the supercritical fluid becomes liquid or gas. The previously dissolved components are no longer soluble and phase separation takes place, which results in the separation of these components to the bottom of cyclone separator (10). The gas may be condensed and cooled down into liquid with heat exchanger (12), or alternatively the liquid could be cooled. The resulting liquid is pressurized and heated into supercritical, subcritical or liquid before recycling back to solvent pump (5) for continuous operation. The dissolved components (18) are preferably periodically drawn off cyclone separator (10) in a controlled-manner.

Figure 2:
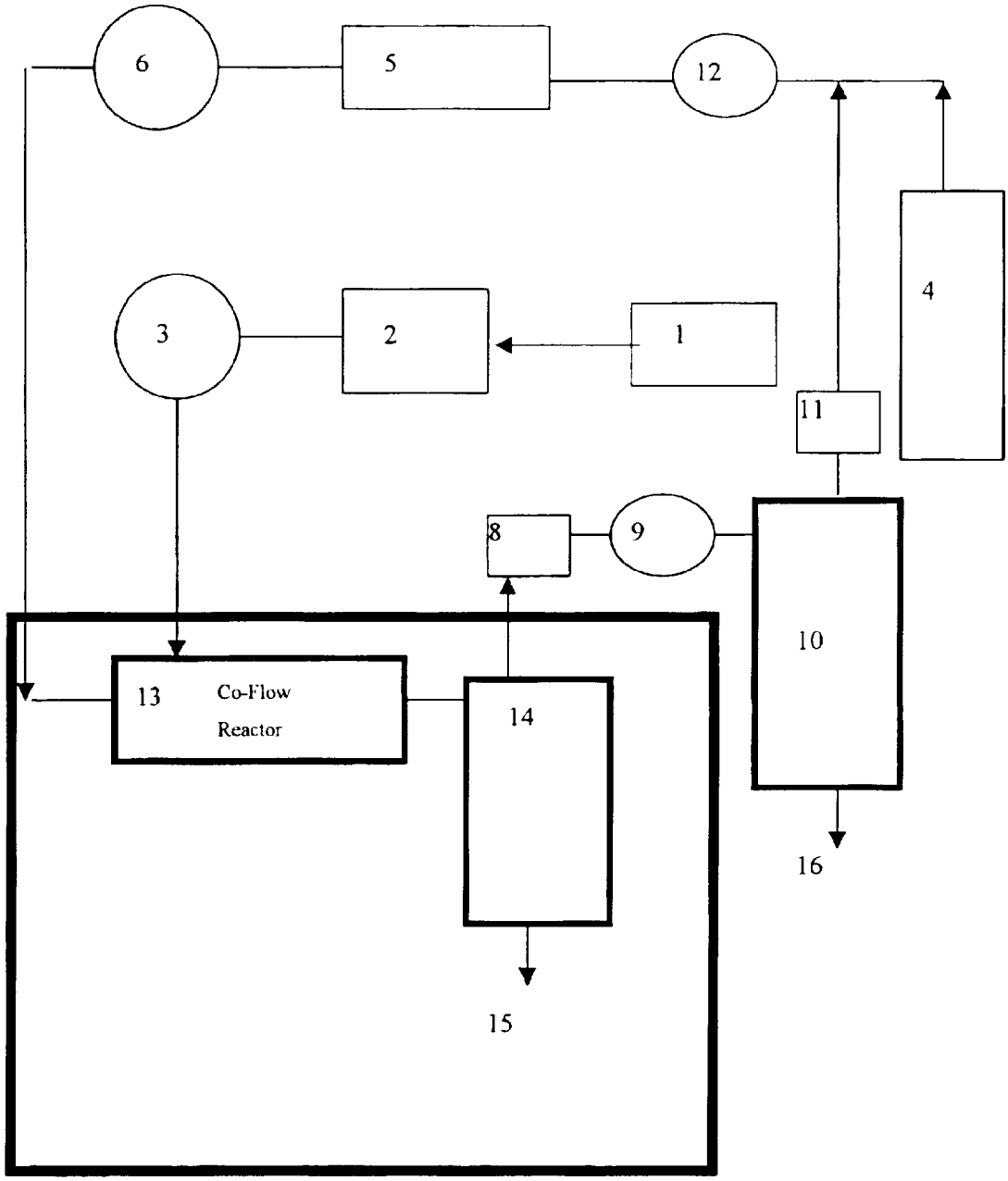
FIG. 2 is a block diagram of sub-system in co-flow operation.

Referring now to FIG. 2, a block diagram of sub-system (100) in co-flow operation is shown. In this embodiment, sub-system (100) includes a high-pressure reactor (13), and cyclone separator (14). The pre-filtered fluid is injected into the high-pressure reactor (13) as described below. Cyclone separator (14) is used for the separation of dissolved and un-dissolved components from the supercritical fluid. The un-dissolved components in the supercritical fluid are allowed to precipitate and settle out in cyclone separator (14) and these un-dissolved components (17) are preferably periodically drawn off in a controlled manner. Backpressure regulator (15) and heat exchanger (16) are used in conjunction with cyclone separator (10) and backpressure regulator (11) to phase out the dissolved components in the supercritical fluid as discussed above.

Figure 3:
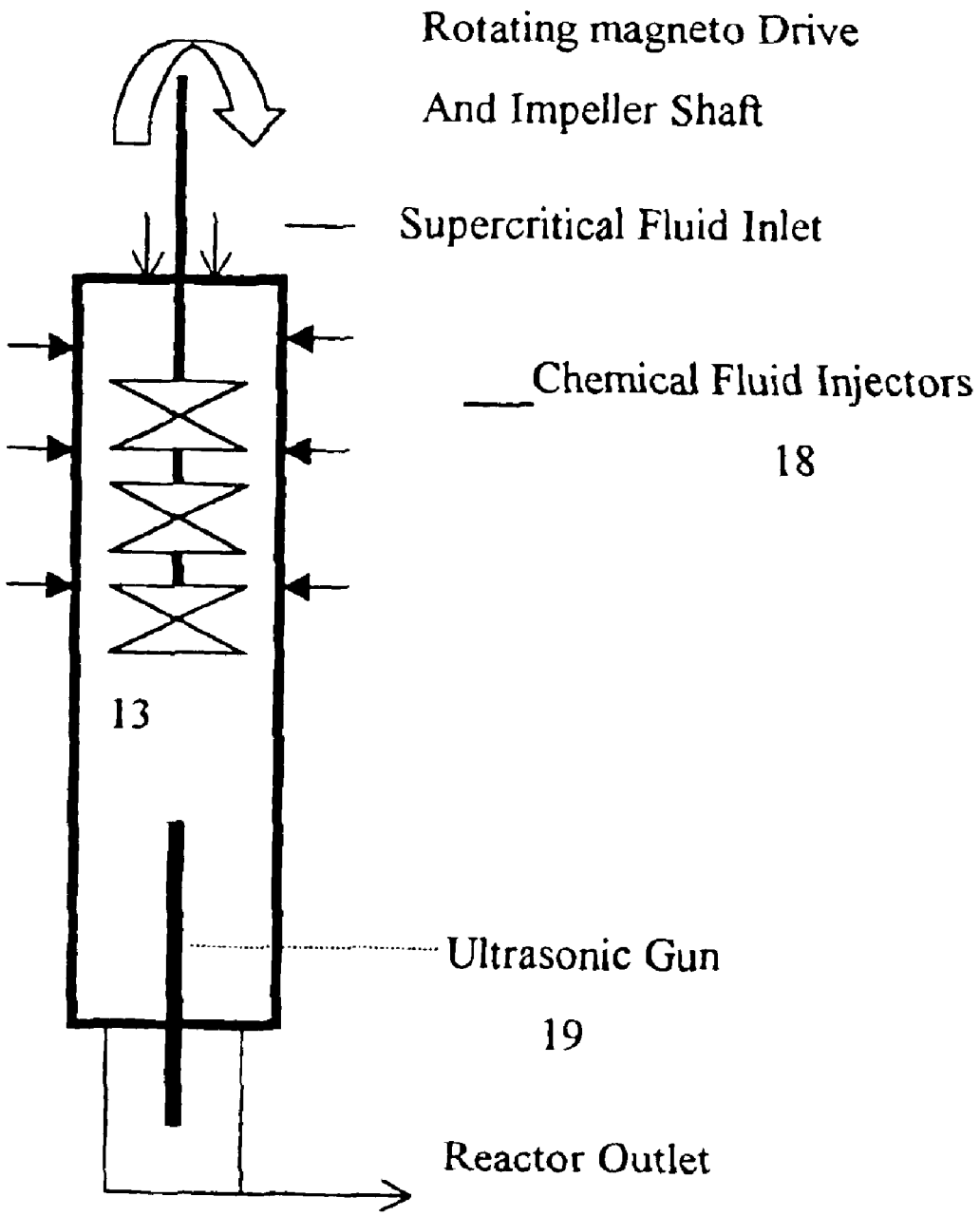
FIG. 3 is a block diagram of preferred action within the high-pressure reactor.

Referring now to FIG. 3, the preferred action within high-pressure reactor (13) is shown. The supercritical fluid enters from one end of the reactor. The jet spray of the chemical fluid is done perpendicular to the flow of the supercritical fluid. High-pressure jet spray micro-orifices (20) atomize the fluid to micro droplets inside the supercritical fluid reactor (13) resulting in a mixing of the two fluids and the solubilization of some components into supercritical fluid. The solubility depends on the type and conditions of the supercritical fluid, and polarity and the chemical structure of the molecules in the processed fluid. To ensure complete mixing of the processed fluid and the supercritical fluid without creating backpressure, a magneto driven impeller shaft (19) is preferably employed along the axis of the reactor (13). This active mixing tool ensures complete mixing and consequently achieving thermodynamic equilibrium during the contact time between the supercritical fluid and the fluid being processed. An ultrasonic gun (21) made of titanium is preferably inserted on the other side of the reactor to add micro-mixing agitation. Ultrasonication in supercritical conditions can create sinusoidal compression/decompression waves inside the supercritical reactor. The advantage of this technology is to increase mixing strength to a maximum level extending to the molecular level. This tool is additional factor to achieving thermodynamic equilibrium in the reactor (13). Because the fluid to be processed and the supercritical fluid, collectively the fluids, travel together through the system from this point on, the process is referred to as a co-flow process.

Figure 4:
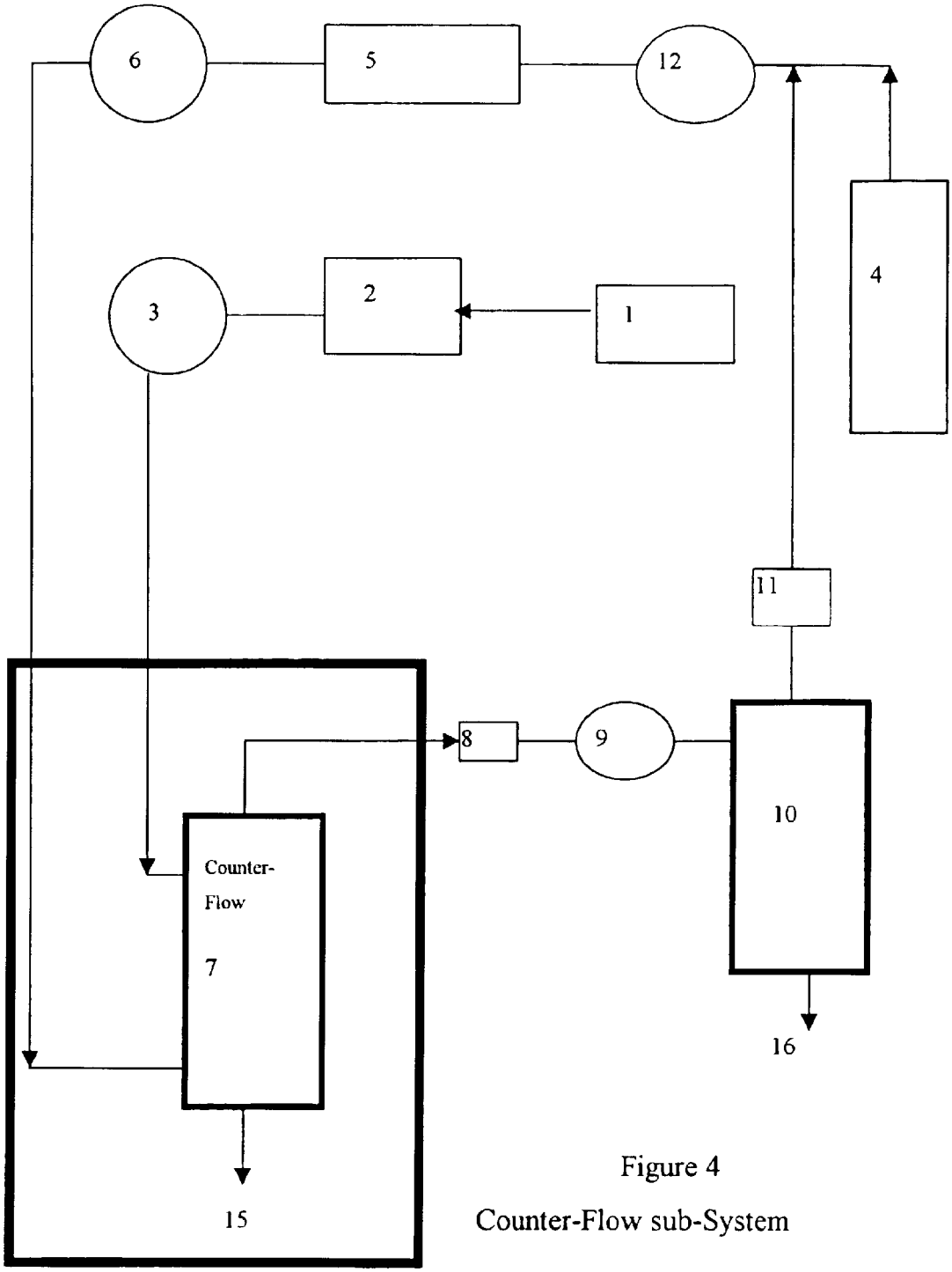
FIG. 4 is a block diagram of a sub-system in counter-flow operation.

The present invention combines two fluids (the fluid being processed and a supercritical fluid) at high pressure and achieves active mixing by a device employing jet spray micro-orifices, impeller shaft, and ultrasonic gun. Using passive mixing such as static mixing elements may be simpler, however, problems such as excessive back-pressure and incomplete mixing may be created in the due process. The purpose of this is to vigorously atomize the processed fluid and mix two components into essentially one homogenous suspension phase and achieve full thermodynamic equilibrium during the resident time in the reactor. This attribute is derived from the turbulence and the fluids' high linear flow velocity. When the fluids are no longer subjected to the turbulent mixing, the fluids will separate into individual components according to density and molecular weight and according to their solubility in the supercritical fluid. The insoluble and heavy material will settle out collecting in the bottom of the cyclone separator (14). The solution of supercritical fluid, which includes dissolved components, will flow from the top of the first cyclone separator (14) to the second cyclone separator (10). One aspect of the present invention is that a series of cyclone separators precisely calibrated for temperature and pressure create unique environments and will phase out higher molecular weight components in earlier separators and progress to lighter components in subsequent separators without pressurizing or expending additional energy FIG. 4 is a block diagram of sub-system (100) in counter-flow operation. Typically, this embodiment is used in pharmaceutical applications where there objective os stripping lighter components from a polymer solution. In this embodiment, sub-system (100) includes vertical reactor (7) and the dissolved and the un-dissolved components are separated inside the vertical reactor (7) during operation, thus eliminating the need for cyclone separator (14) as shown in FIG. 4. It should be noted, however, that a single or multiple separation vessel such as cyclone separator (14) may be added to sub-system 100 as required to fractionate the soluable components into different fractions according to their molecular weights.

Referring now to FIG. 5, the preferred action within reactor 7 is shown. Reactor (7) is preferably perpendicular and long in length to increase the contact time between the processed fluid and the supercritical fluid. The nature of the flow inside the reactor is not turbulent in comparison with the co-flow process. The supercritical fluid again enters from one end of the reactor. The jet spray of the chemical fluid is preferably done at a 45° angle opposing the flow of the supercritical fluid. As discussed above, high-pressure jet spray micro-orifices (20) atomize the fluid to micro droplets inside the supercritical fluid reactor (7) resulting in a mixing of the two fluids and the solubilization of some components into supercritical fluid. The solubilization of the dissolved components in the supercritical fluid depends on the atomization of the injected fluid into the stream of supercritical fluid.

The flow of the supercritical fluid in the vertical reactor is upward. During the contact time between the supercritical fluid and the atomized injected fluid, the dissolvable components will be carried upward by the supercritical fluid. The higher density of the un-dissolved components will result in the sedimentation down ward due to the gravity. The accumulated un-dissolved components can be removed periodically from the bottom of the reactor itself The dissolved components can be separate from the supercritical fluid using one cyclone separator (10). A magneto drive impeller shaft is not used inside the reactor (7) in the counter-flow process. An ultrasonic gun (21), discussed above, optionally may be used as it works by increasing micro agitation without disturbing the opposite flows of the supercritical fluid (up) and the processed fluid (down).

In either of the preferred embodiments, the system of the present invention is usually closed during operation but may be open if recycling of the supercritical fluid is not desired in small-scale research operation. Temperature sensors, not shown in the Figures, monitor the temperature of the fluids in reactors (7,13), and the cyclone separators (14) (10). That information may be relayed to a central control system, which may, in turn, control the heat source. Temperature and pressure are not only necessary in controlling the conditions in the supercritical fluid reactors (7,13) of the system, but are necessary in controlling conditions when multiple separators are used. Those of ordinary skill in the art will recognize that pressure gauges, valves, and other devices will be needed to properly operate the system shown in FIG. 1 and the reactors shown in FIGS. 2 and 4. Such devices are well known in the art and have been omitted from these Figures for purposes of clarity. Moreover, the present invention may be easily scaled with respect to flow and volume.

In either of the preferred embodiments, the supercritical fluid acts as a solvent selectively dissolving certain components of the processed fluid. Table 1 is an example of some of the conventional supercritical fluids that are commercially available and may be used in the present invention.

TABLE 1

Physical Parameters of Selected Supercritical Fluids

| Super-Critical Fluid | Critical Temperature $T_c$ (° C.) | Critical Pressure $P_c$ (atm) |
|---|---|---|
| $CO_2$ | 31.3 | 72.9 |
| $N_2O$ | 36.5 | 72.5 |
| $NH_3$ | 132.5 | 112.5 |
| $CH_4$ | 82.1 | 45.8 |
| $C_2H_6$ | 32.2 | 48.2 |
| $C_3H_8$ | 96.8 | 40.0 |
| $C_4H_{10}$ | 152.0 | 37.5 |
| $C_5H_{12}$ | 196.6 | 33.3 |
| $SF_6$ | 45.5 | 37.1 |
| Xe | 16.6 | 58.4 |
| $CCl_2F_2$ | 111.8 | 40.7 |
| $CHF_3$ | 25.9 | 46.9 |

All conventional solvents and detergents, such as methanol, ethanol, hexane, acetic acid, $N_2O$ , etc., can be used as a co-modifier to enhance the solubility parameters of supercritical fluids as well as to increase specificity of the solvation power of the supercritical fluid. Modifiers (usually an organic solvent), usually increase the solvation power of the supercritical fluids. Modifiers may dissociate sample molecules by forming clusters around them. These clusters may dissolve more rapidly in supercritical fluids in comparison with sample molecules. Analog modifiers can make supercritical fluids more selective for certain types of components depending on their chemical structure. The analog modifier shares at least a common functional group with the component to be selectively solubilized by the supercritical fluids. By adding the modifier directly to the supercritical fluid, and monitoring their concentration on line, or by premixing modifiers with the fluids to be processed, the selectivity of the supercritical fluid can be "tuned" to the fluid being processed.

The molecules of $CO_2$ and propane (the preferred supercritical fluids) are both non-polar, and hence they can dissolve very little of polar components such as water and PCB's. The sludge, dirt, and heavy metals do not dissolve either in non-polar molecules. Propane has the advantage over $CO_2$ in having more solvation power toward similar hydrocarbon molecule in the used oil, as liquid, sub-critical, and supercritical phases of propane. Accordingly the propane/used oil ratio is much lower than that of $CO_2$/used oil ratio. This is an advantage from energy consumption during operation.

Propane is the preferred supercritical fluid as it can dissolve at least five times more oil than $CO_2$ during operation and this means about five times less energy used to process the same amount of used oil in a continuous process. In the process Energy is used to Heat, Cool, Compress various phases of the solvent during operation. (See Subramanian, M Supercritical fluid extraction of oil sand bitumen from Uinta Basin, Utah, Ph.D. dissertation, University of Utah, Salt lake city, Utah, 1996).

Data regarding the soluability of water, sludge, dirt, heavy metal are well established for supercritical $CO_2$ and super/sub-critical propane, using static systems and path processes. For example, see Heng-JooNg et. al at D. B. Robinson Research Ltd., 9419-20 Avenue Emdmonton, Alberta, Canada T6N1E5.

At expected running conditions of 93.3 C. (200 F) and 4000 psi. The equilibrium phase properties indicate that at 93.3 C. (200 F.) the dissolved water in those conditions is (674E−03). The propane concentration is (1.03E+03), and the $CO_2$ concentration is (3.91E+01). The data indicate that the solubility of water at equilibrium in $CO_2$ is 263 times more than that in Propane under the same condition. Water concentration, can be reduced at equilibrium from 6.74E−03 down to 1.88E−03 by reducing temperature isobonically in the first cyclone separator when multiple cyclone separators are used. This is clearly an advantage in the case of propane, where coalescent filtration may be eliminated, from the process to polish the final product. The same principles applies to larger polar molecules such as contaminating PCB's which has no solubility in non polar molecules such as propane and $CO_2$.

The maximum pressure in a propane-based system is less than 5,000 psi for maximum efficiency, whereas in the $CO_2$ system the maximum pressure will be 10,000 psi to increase the solvation power of supercritical $CO_2$. The downside of higher pressure is the tremendous increase in the cost of equipment and safety costs.

All materials not soluble in solvent are separated in the first cyclone separator in the co-flow process during operation and removed from the bottom of the reactor in the counter-flow process. These unwanted materials can be removed periodically from the separator or subjected to further treatment to make them non-toxic as the case with PCB's. PCB's can be rendered harmless with supercritical water oxidation by adding additional modules at the bottom outlet of cyclone separator (14). Since the system under pressure, there is no energy consumption regarding pressurization for any treatment of the separated material in cyclone separators (14 and 10).

The present invention may also be used in processes other than the purification of petroleum-based products. The fields of application include many industries such as chemical environmental, food, medical, enzymatic, pharmaceutical and recycling. The type of the supercritical fluid and the conditions of temperature and pressure, solvent ratio and other relate operation parameters are determined for each application to obtain the desired final product at minimal cost of system construction and system operation. A bench top research unit can be used to obtain the operation parameters. A pilot plant of medium capacity (one gallon/minute of processed material) is more suitable to give operational data regarding material and waste handling, energy consumption and total cost analysis of the process including the added premium per gallon of the processed waste fluid.

The difference in the solubility of various chemical components in supercritical fluids is the bases of the present invention. This principle can be used to recycle many industrial waste fluid such as used engine oil, used transformer oil, used ink, use cooking oil and many other industrial fluids. And removal of heavy metals from nuclear industry waste using detergent modified supercritical fluid Many chemical mixtures cannot be separated completely, into their individual components, because they are azotrope mixtures, e.g., water and ethanol. A 95% azotrope mixture of water and ethanol can be purified further to 99.9% of ethanol, due to high solubility of ethanol in the supercritical fluid $CO_2$.

Food industry applications of the present invention are potentially many and they include removal of fatty material from food products such as removal of cholesterol from milk. Other examples of applications of the present invention include a continuous extraction and fractionation of butter oil, glycerides, citrus oil. Further examples of applications of the present invention include the continuous.

One of the many applications of the present invention is sub-critical'supercritical water oxidation, water and air (or hydrogen peroxide) can be mixed at a temperature and pressure above critical parameters of water (critical temperature 374° C. and critical pressure 216 atm), for example, oxidation of polychlorinated biphenyls with hydrogen peroxide, hydrolysis of nitriles at sub-critical water conditions, oxidation of methane into methanol with supercritical water, and the continuous photo-oxygenation of benzene in carbon dioxide.

Supercritical fluid reactions based applications of the present invention are continuous emulsion and dispersion polymerization of N-vinyl formamide in carbon dioxide, a continuous deacidification of vegetable oils, a continuous alkylination of isobutene and isobutene in supercritical water, a continuous reaction of alkyl aromatics and supercritical water, continuous production of polymeric material under supercritical fluid conditions.

Other examples of use of the present invention for fractionation of many types of copolymers include using polypropylene-polyethylene copolymers to remove the low and high molecular weight fractions and the production of medical grade products of very high value on a continuous manner. The process can be used as a recycling process for old polymeric rags and carpet. In this case the old rag material is dissolved in solvent, and fractionation and crystallization using the present invention is performed. Other examples of applications of the present invention, includes the continuous depolymerization of polymers and a continuous production of lipid free human plasma products.

Commercially available computer programs in industrial design and processing can simulate many of those applications. Phase equilibrium data for each component in the processed can be predicted based on the modified equation of state (Bing-Robinson). These programs can be used to predict the design parameters of the system at any scale to insure maximum efficiency of operation.

While the present invention has been described in conjunction with preferred embodiments thereof, those of ordinary skill in the art will recognize that many modifications and variations may be made. The following claims are intended to cover all such modifications and variations.

What is claimed is:

1. A method of processing a fluid, comprising:

atomizing said fluid in a supercritical fluid medium to dissolve at least one component in the fluid to be processed:

applying thermal energy lo said fluid;

allowing an dissolved components to settle: and separating said dissolved components from said supercritical fluid.

2. The method of claim 1, wherein said atomization is accomplished by dynamic atomization.

3. The method of claim 2, wherein said method additionally comprises the step of utilizing jet spray orifices during said atomization step.

4. The method of claim 2, wherein said method additionally comprises the step of adding sonic energy during said atomization step.

5. The method of claim 1, wherein the thermal energy is applied after atomizing said fluid in the supercritical fluid.

6. The method of claim 1, wherein the thermal energy is applied to the fluid to be processed before atomizing said fluid in the supercritical fluid.

7. The method of claim 1, wherein the supercritical fluid is selected from a group consisting of $CO_2$, $N_2O$, $NH_3$, $CH_4$, $C_2H_6$, $C_3$, $H_8$, $C_4H_{10}$, $C_5H_{12}$, $SF_6$, Xe, $CCl_2F_2$, and $H_2O$.

8. The method of claim 1, additionally comprising the step of adding a modifier to enhance the solubility of the supercritical fluids.

9. The method of claim 1, additional comprising the step of recycling said supercritical fluid.

* * * * *

UNITED STATES PATENT AND TRADEMARK OFFICE

CERTIFICATE OF CORRECTION

PATENT NO. : 6,821,413 B1
APPLICATION NO. : 09/654097
DATED : November 23, 2004
INVENTOR(S) : Alkhalidi It is certified that error appears in the above-identified patent and that said Letters Patent is hereby corrected as shown below:

On the Title Page, item (12) & item (75)

Please change "Abdulhaq E. Alkhalidl" to --Abdulhaq E. Alkhalidi--

Signed and Sealed this

Twenty-ninth Day of April, 2008

JON W. DUDAS
*Director of the United States Patent and Trademark Office*